US009168448B2

(12) United States Patent
Donnadieu et al.

(10) Patent No.: US 9,168,448 B2
(45) Date of Patent: Oct. 27, 2015

(54) POLE/WRIST STRAP ASSEMBLY

(71) Applicant: SALOMON S.A.S., Metz-Tessy (FR)

(72) Inventors: Thierry Donnadieu, Sillingy (FR); Eric Girault, Annecy (FR)

(73) Assignee: SALOMON S.A.S., Metz-Tessy (FR)

( * ) Notice: Subject to any disclaimer, the term of this patent is extended or adjusted under 35 U.S.C. 154(b) by 0 days.

(21) Appl. No.: 14/568,761

(22) Filed: Dec. 12, 2014

(65) Prior Publication Data

US 2015/0165305 A1 Jun. 18, 2015

(30) Foreign Application Priority Data

Dec. 16, 2013 (FR) ..... 13 02951

(51) Int. Cl.
*A63C 11/22* (2006.01)
*A45B 9/02* (2006.01)

(52) U.S. Cl.
CPC ..... *A63C 11/222* (2013.01); *A45B 9/02* (2013.01); *A45B 2009/025* (2013.01)

(58) Field of Classification Search
CPC .... A63C 11/22; A63C 11/222; A63C 11/227; A63C 11/228
USPC ..... 280/819, 821, 822; 135/65, 67, 72, 76
See application file for complete search history.

(56) References Cited

U.S. PATENT DOCUMENTS

| | | | | |
|---|---|---|---|---|
| 5,092,629 | A | 3/1992 | Bagneres et al. | |
| 5,123,674 | A | 6/1992 | Bagneres et al. | |
| 5,443,287 | A * | 8/1995 | Wells | 280/822 |
| 6,325,418 | B1 * | 12/2001 | Lenhart | 280/821 |
| 6,637,773 | B1 * | 10/2003 | Trinen et al. | 280/821 |
| 6,988,745 | B2 | 1/2006 | Trinen et al. | |
| D527,065 | S | 8/2006 | Schary et al. | |
| 7,322,612 | B2 | 1/2008 | Trinen et al. | |
| 7,891,708 | B2 * | 2/2011 | Panizza | 280/822 |
| 8,714,172 | B2 * | 5/2014 | Heim | 135/72 |
| 2010/0218347 | A1 | 9/2010 | Lenhart | |
| 2014/0165336 | A1 | 6/2014 | Guyoton | |

FOREIGN PATENT DOCUMENTS

| | | | |
|---|---|---|---|
| EP | 0 370-900 | A1 | 5/1990 |
| JP | H04 51976 | A | 2/1992 |
| JP | H04 70072 | U | 6/1992 |

* cited by examiner

*Primary Examiner* — John Walters
(74) *Attorney, Agent, or Firm* — Greenblum & Bernstein, P.L.C.

(57) ABSTRACT

A pole/wearable article assembly that includes a pole, a handle for the pole, and a wearable article designed to at least partially cover a user's hand. The wearable article includes an element for fastening to the handle. The handle includes the following: a body having a housing to receive the fastening element; a retaining element cooperating with the fastening element when the latter is within the rear housing; and a latch. The retaining element is movable in relation to the body between a position for retaining the fastening element and a position for releasing this fastening element. The latch is movable between a locking position in which the latch cooperates with the retaining element so as to maintain the retaining element in its retaining position, and an unlocking position in which the latch no longer cooperates with the retaining element to maintain it in its retaining position. The handle of the assembly includes a return mechanism biasing the latch towards its locking position.

20 Claims, 4 Drawing Sheets

POLE/WRIST STRAP ASSEMBLY

CROSS-REFERENCE TO RELATED APPLICATION

This application is based upon French Patent Application No. 13/02951, filed Dec. 16, 2013, the disclosure of which is hereby incorporated by reference thereto in its entirety, and the priority of which is claimed under 35 U.S.C. §119.

BACKGROUND

1. Field of the Invention

The invention relates to assemblies comprised of a pole and a wearable article.

Assemblies of the aforementioned type can be used while practicing any of cross-country skiing, ski touring, hiking, or mountaineering, and Nordic walking, as well as other activities. The invention also relates to an assembly of a pole and a handle, as well as to the handle.

2. Description of Background

The wearable article associated with the pole is generally a wrist strap wrapping the hand of the skier. The wrist strap can take the form of a glove or a strap forming a closed loop. Connected to the handle, the wrist strap prevents the skier from dropping the pole when he/she releases the handle. The wrist strap also makes it possible to improve the transmission of the skier's thrust forces to the pole, which is particularly advantageous for the practice of winter sports and summer activities mentioned above. The wrist strap also enables transmission of these bearing forces for a longer period of time, in particular because such transmission can be carried out without clenching of the user's fingers around the handle.

During practice of cross-country skiing, constant contraction of the hand muscles when taking supports can result in muscle soreness or muscle pain. Thus, a number of athletes lightly grip the pole handle with their fingers to avoid causing muscle pain in their hands and forearms. The wrist strap is thus used as a vector in the transmission of the propulsive force between the hand of the skier and the pole. The pole is then retained by the wrist strap, thereby also enabling the user to quickly grab the handle again to plant the same further forward.

In certain designs, the wrist strap can selectively be affixed to or separated from the grip handle.

A number of documents disclose such a wrist strap.

The Patent Publication EP 0 370 900 discloses various mechanisms for fastening the wrist strap on a handle, some of such mechanisms comprising a retaining element cooperating with a connecting element of the wrist strap and a latch for locking the retaining element in a configuration for engagement with the connecting element. In these solutions, the latch is not energized to switch to a stable position. In addition, it is apparent that these constructions are not very ergonomic in use, particularly for operating the latch. Due to the kinematics, it is impractical to actuate the latch with one hand, without using the other hand. Finally, these systems present a risk of unintentional triggering that releases the latch if the handle becomes caught or snagged during use.

SUMMARY

The invention provides an improved pole/wearable article assembly.

In particular, the invention provides a handle for reliably attaching the wearable article, without risk of accidental detachment.

The invention also makes it possible to separate the wearable article and the handle, with one hand, and in a reduced amount of time.

Further, the invention enables a wearable article to be ergonomically attached to/detached from a handle. The invention also provides a handle with good gripping ergonomics and a large gripping surface.

Still further, the invention provides a handle that is compatible with a wrist strap having a flexible connecting element to facilitate the use of a rifle during practice of biathlon.

The invention overcomes one or more of the aforementioned disadvantages. Thus, the invention relates to a pole/wearable article assembly comprised of a pole provided with a handle and a wearable article adapted to at least partially cover the hand of a user, the wearable article being provided with an element for fastening to the handle. The pole handle comprises a body having a housing for receiving the fastening element; a retaining element adapted to cooperate with the fastening element when the latter is housed in the housing, the retaining element being movable in relation to the body between a position for retaining the fastening element and a position for releasing the fastening element; a latch movable in relation to the body between a locking position in which the latch cooperates with the retaining element so as to keep the retaining element in its retaining position and an unlocking position in which the latch no longer cooperates with the retaining element to keep it in its retaining position.

The handle further comprises a return mechanism biasing the latch towards its locking position.

This construction favors locking the element for retaining the fastening element due to the return mechanism. This reduces the risk of unintentional detachment of the wrist strap from the handle. To release the wrist strap, it suffices to actuate the latch by acting against the force generated by the return mechanism. Proprioception is clear. The maneuver is ergonomic.

According to advantageous but not essential aspects of the invention, an assembly of this type may incorporate one or more of the following characteristics, taken in any technically acceptable combination:

- The latch is a lever pivotally mounted in relation to the body about a tilting axis transverse to the body, the lever comprising a first arm extending forward of the handle, along a substantially horizontal direction, the forward tilting of the first arm causing the unlocking of the retaining element.
- The return mechanism biases the retaining element towards its release position. In a particular embodiment, the return mechanism is interposed between the latch and the retaining element.
- The retaining element tilts in the retaining position by manual action directly thereon by the user.
- The latch unlocks the retaining element only if the latter is not kept in the retaining position by the user.
- The retaining element is a lever pivotally mounted in relation to the body about a tilting axis transverse to the body, the lever comprising a first arm extending along a substantially vertical direction. Advantageously, the lever has an outer surface flush with the body in the retaining position.

The invention also relates to a pole equipped with a handle for a pole/wearable article assembly such as defined above.

The invention also relates to a handle for a pole adapted to form a pole/wearable article assembly such as defined above.

BRIEF DESCRIPTION OF DRAWINGS

Other characteristics and advantages of the invention will become apparent from the following description, provided by way of non-limiting example only, with reference to the annexed drawings, in which.

DETAILED DESCRIPTION

The following description makes use of terms such as "horizontal", "vertical", "longitudinal", "transverse", "upper", "lower", "top", "bottom", "front", "back". These words are to be interpreted in relative terms in relation to the normal position of the pole during use of the pole and wearable article assembly (described in detail below), and the user's normal advance direction. For example, the terms "vertical" and "longitudinal" correspond to the direction of the longitudinal axis of the pole. The term "top" designates the top of the handle and the term "bottom" designates the end of the pole, towards the tip.

Figure 1:
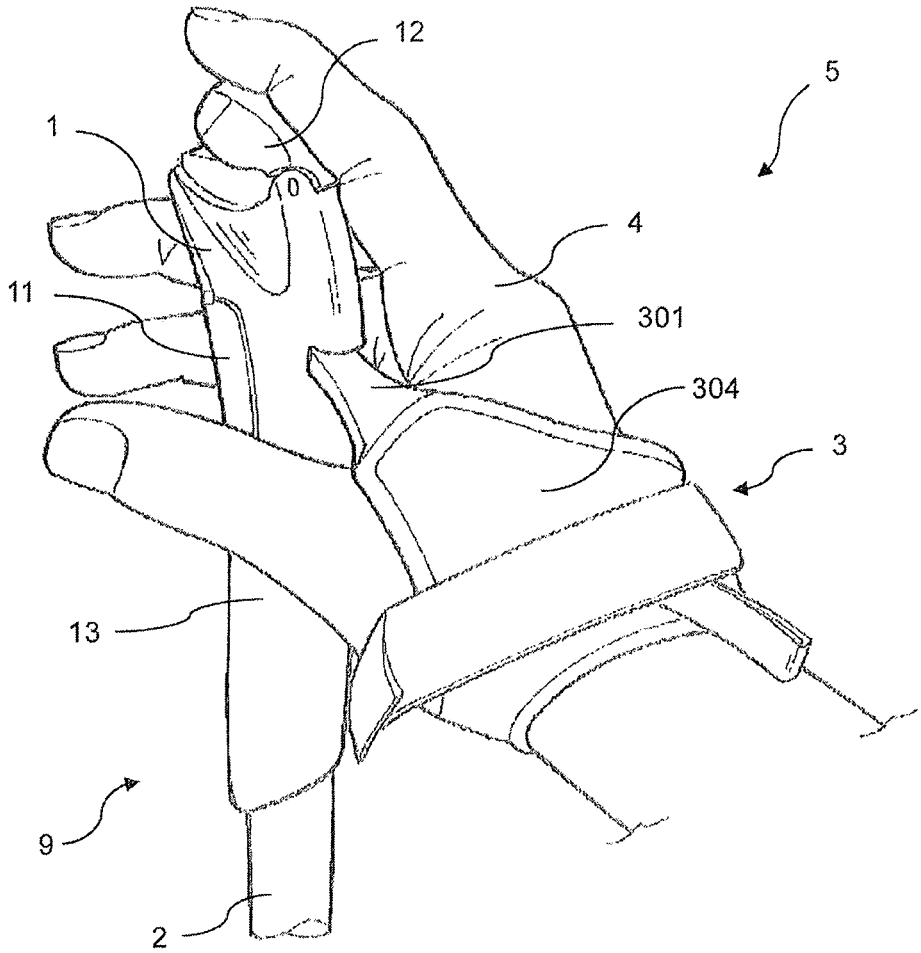
FIG. 1 is a perspective view of a pole handle according to an embodiment of the invention, affixed to the glove of a user.
Figure 2:
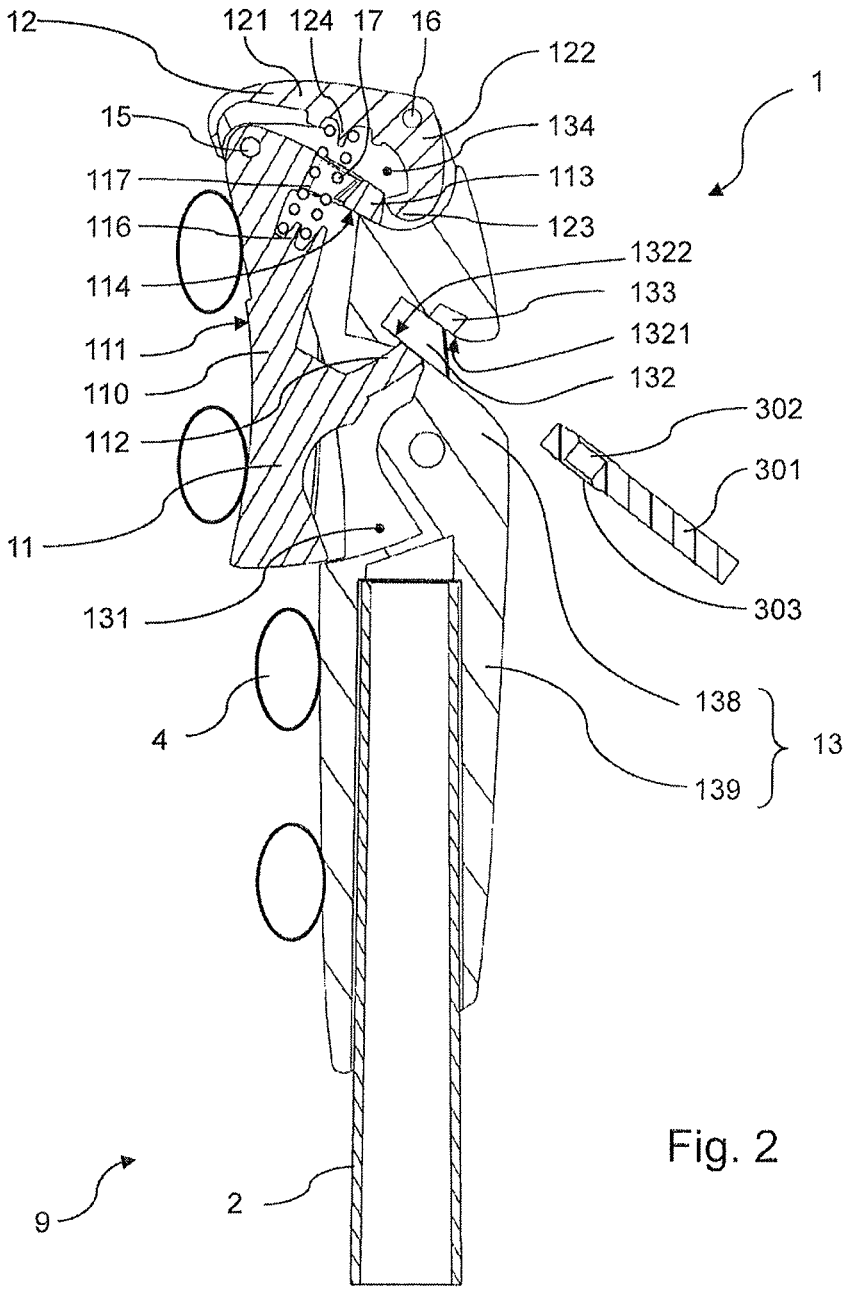
FIG. 2 is a longitudinal cross-sectional view of the handle of FIG. 1 in a configuration for detachment from a glove.
Figure 3:
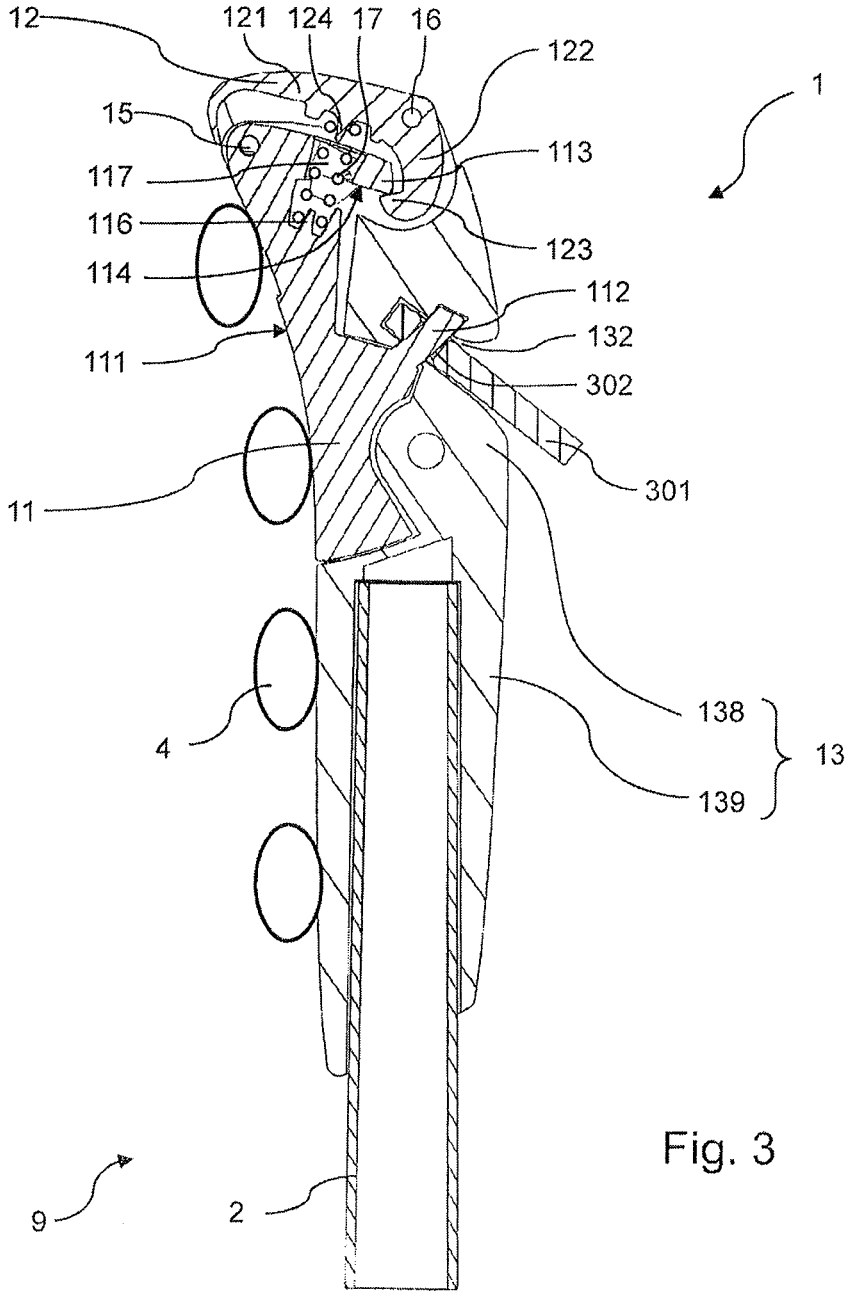
FIG. 3 is a longitudinal cross-sectional view of the handle of FIG. 1 in a configuration for attachment to a glove.

FIG. 1 is a perspective view of a pole/wearable article assembly 5 comprising a pole 9 and a wearable article 3 according to an embodiment of the invention. In this example, the wearable article is a wrist strap 3 in the form of an envelope 304 partially covering the user's hand. This wrist strap is provided with a tongue 301 supporting a fastening element 302, here in the form of a bore. FIG. 3 is a longitudinal cross-sectional view of the assembly 5. In FIGS. 1 and 3, the handle 1 is in the configuration for attachment to the wrist strap 3. FIG. 2 is a longitudinal cross-sectional view of the handle 1 in the configuration for detachment from the wrist strap 3.

In this example, the envelope constituting the wrist strap covers the palm and back of the hand of the user. A tongue 301 is fixed to the portion 304, in the area of junction between the index finger and thumb. The tongue 301 comprises a free end in the area of which an eyelet 303 or a rivet is fixed. The eyelet 303 demarcates the bore 302 extending through the thickness of the tongue 301. The eyelet enables the application of forces to the tongue 301, without risk of fraying the tongue 301, particularly when the tongue is made of textile.

The pole 9 here comprises a tube 2 that is elongated along a longitudinal direction. The handle 1 is fixed to the upper end of the tube 2. The handle 1 has a body 13, the shape of which is elongated along the longitudinal direction. The body 13 comprises an upper portion 138 and a lower portion 139. The lower portion 139 here comprises a bore in which the tube 2 is fitted. The upper portion 138 includes a retaining mechanism cooperating with the fastening element 302. The upper portion 138 of the body further comprises a housing 132. In this embodiment, the housing 132 opens out onto the rear portion of the handle, oriented towards the palm of the hand, in the upper half of the body. The rear housing 132 forms a cavity for receiving the fastening element 302. Here, the cavity is inclined with respect to a plane normal to the longitudinal direction of the body. In the illustrated example, a median plane of the housing 132 forms an angle less than 60° in relation to a plane normal to the longitudinal direction. In a particular embodiment, this angle can be less than 45°. The median plane corresponds to the plane equidistant from the upper 1321 and lower 1322 surfaces of the portion of the body demarcating the housing 132.

The handle 1 comprises a retaining element 11 and a latch 12. The body 13 comprises a first recess 131 forming an open cavity toward the front of the body. This first recess 131 selectively makes it possible to house most of an inner portion of the retaining element 11.

The body further comprises a second recess 134 forming an open cavity toward the upper portion of the body. The second recess 134 makes it possible to house an inner portion of the retaining element 11 and an inner portion of the latch 12.

In this example, the retaining element 11 forms a lever pivotally mounted in relation to the body, about an axis transverse to the body. Thus, the lever rotates about a transverse shaft 15 fixed to the body 13 and positioned in the area of the upper end of the body.

The retaining element 11 comprises a first arm 110 extending along a substantially vertical direction, downward along the body. The arm is dimensioned so that, depending upon its angular position, the arm projects from the body forward (see FIG. 2), or is inserted almost entirely in the first recess 131 (see FIG. 3). In the latter case, only the front side of the arm is flush with the front outer envelope of the body 13.

The first arm 110 comprises a support surface 111 for at least one finger of the user's hand. The support surface is positioned on the front side of this element. It enables the user to pivot the retaining element 11 rearward with his/her fingers. Advantageously, the support surface 111 extends over a length greater than one third of the length of the body to allow for support of the index and middle fingers. This characteristic enables better handling of the retaining element 11 by the user. The actuation ergonomics are improved. The ring and little finger of the hand 4 can come into support against the front surface of the lower portion 139 of the body. The body 13 of the handle 1 is designed to be surrounded by the hand 4 of the user.

The first arm 110 also comprises a hooking element 112, projecting within the housing 131 and oriented rearward of the body 13. The hooking element 112 is here arranged in the lower half of the arm 11. The hooking element 112 is designed to cooperate with the fastening element 302 of the strap 3. These two elements thus have complementary shapes to ensure the necessary retention. In this case, the hooking element is a pin 112 that is inserted into the bore of the fastening element 302 forming the fastening element or, conversely, exits therefrom.

The pin 112 is essentially included in the housing 131 to ensure its protection against external forces, or biases.

The rotation of the retaining element 11 causes the displacement of the pin 112 which tilts between a retaining position (FIG. 3) in which the pin extends, at least partially, through the rear housing 132 of the body and a release position (see FIG. 2) in which the pin does not penetrate into the rear housing.

When the end of the tongue 301 is inserted into the rear housing 132 until it abuts against an inner face of the housing, the bore 302 is positioned within the rear housing at a predetermined position included in the path of the pin 112. Indeed, the retaining element is arranged in relation to the body so that the path of the pin passes through the bore 302 when the tongue 301 has been inserted into the rear housing. In other words, when it switches to the retaining position, the pin 112 is inserted into the bore 302 when the latter is housed in the rear housing. In this configuration, the pin 112 cooperates with the bore 302 to retain the wrist strap 3. The retaining element 11 is in the position for retaining the fastening element 302.

Conversely, when the pin 112 is retracted from the rear housing 132, that is, set back in relation to the lower surface 1322 with respect to the housing 132, the pin is no longer in engagement with the bore 302. The wrist strap can be detached from the handle. The retaining element 11 is in the position of release of the fastening element 302.

In the illustrated example, the pin 112 in the retaining position extends perpendicular to the median plane of the opening 132. This facilitates the penetration of the pin 112 in the bore 302 of the eyelet 303. Furthermore, this ensures reliability of the locking when a pulling force is applied on the strap 301, as the latter does not tend to pivot the retaining element 11.

Advantageously, in the retaining position, the pin 112 extends completely through the rear housing 132, and its free end is inserted into a recess 133 of the body opening out onto the upper surface 1321 of the rear housing 132. Consequently, the pin 112 is held by two bearing surfaces of the body, on both sides of the opening 132. This construction enables better anchoring of the pin 112 in the body and therefore ensures better retention of the wrist strap to the handle when the retaining element 11 is in the retaining position.

The retaining element 11 comprises abutments to limit its angular displacement.

In the direction of rearward tilting, the retaining element 11 has an inner portion which abuts against an inner wall of the first recess 131 of the body.

In the other direction of forward tilting, the retaining element 11 has a second arm 113, housed in the second recess 134 of the body 13, the free end 1131 of which abuts against an inner wall of this second recess 134.

In this example, the retaining element 11 therefore forms a lever comprising two arms 110, 113 joined in the area of the hinge axis 15 of the lever.

A through bore 117 is provided here in the second arm 113. In addition, a stud 116, coaxial with the bore 117, projects from the first arm 110 and extends in the direction of the bore 117.

Furthermore, the latch 12 is pivotally mounted with respect to the upper portion 13 of the body via a shaft 16. In this example, the latch forms a lever pivoting about an axis transverse to the body having the same direction as the pivot axis of the retaining element 11. The shaft 16 is positioned in the area of the upper end and at the rear of the body. The lever 12 is at least partially housed in the second recess 134 of the body 13.

The lever 12 comprises a first arm 121 extending forward of the handle, along a substantially horizontal direction. The lever also comprises a second arm 122 extending to the lower portion of the handle in a substantially vertical direction. The second arm 122 is designed to cooperate with the retaining element 11.

The first arm 121 supports a stud 124 arranged to project within the recess 134 substantially opposite the bore 117 when the handle is assembled. The second arm 122 forms a hook 123 at its free end. The hook 123 is housed within the recess 134.

The handle 1 further comprises a return mechanism 17. The return mechanism 17 here is a compression spring. In this example, the spring 17 extends through the bore 117 and takes support on the first arm 121 of the latch 12 and on the first arm 110 of the retaining element 11, respectively. It is retained at its two ends by the stud 116 and the stud 124, respectively. Such retention of the spring 17 at both ends is particularly advantageous when the spring 17 is bent during its operation, as in the example shown, in which the spring does not work in compression only. The bore 117 guides the spring and also helps to maintain it in position. This construction makes it possible to position the spring within the retaining element 11, the spring being slightly held to enable manipulation of this subassembly during assembly. The bore assists the assembly, during which certain elements are mounted blindly.

FIGS. 2 and 3 illustrate the various positions for attaching the wrist strap 3 to the handle 1.

In the configuration of FIG. 2, the pin 112 is in a position of release of the tongue 301. The pin 112 does not interfere here with the housing 132. It then enables the insertion of the tongue 301 up to the end of housing 132, or the retraction of the tongue 301 out of the housing 132. In this configuration, the retaining element 11 is in an angular position in which a portion projects out of the recess 131. In this configuration, the retaining element 11 is biased towards this partially projecting position through the spring 17. This projecting position of the retaining element 11 is restrained by an interference between the free end 1131 of the second arm 113 of the retaining element 11 and an inner wall of the second recess 134 of the body 11.

In the configuration of FIG. 2, the spring 17 biases the first arm 121 of the latch 12 from the inside, at the front of the shaft 15. This action causes the rearward tilting of the lever 12. The spring 17 thus causes the second arm 122 to pivot, so that the hook 123 abuts against the end of the second arm 113 of the retaining element 11, without blocking the movements of the second arm 113.

To switch to the configuration of FIG. 3, the user inserts the tongue 301 into the rear housing 132, such that the bore 302 is aligned with the path of the pin 112. When the user presses on the support surface 111 with his hand 4, the retaining element 11 pivots about the shaft 15, so that a portion thereof is inserted into the recess 131. This operation is intuitive for the user because the portion of the retaining element projecting from the handle is closer to the location of the ends of the index and middle fingers on the handle. This movement evokes the classic operation of a sear trigger. The pin 112 then penetrates into the housing 132 until it is inserted into the bore 302 of the eyelet 303. The pin 112 is then in a position for retaining the tongue 301. The pivoting of the lever 11 also causes the rotation of its second arm 113 about the shaft 15. From a certain angle of rotation, the second arm 113 assumes a position in which the hook 123 no longer presses on the end of the second arm 113. In this configuration, the hook 123 is automatically inserted under the second arm 113 because the spring 17 biases the latch 12 in rotation. The hook 123 is dimensioned so as to maintain the retaining element 11 in its retaining position in which the pin 112 cooperates with the bore 302 and, advantageously, in which the support surface 111 is flush with the envelope of the body of the handle. This locking configuration remains stable due the hook 123 being in contact with the lower surface 114 of the second arm 113. The latch 12 is thus in a position for locking the retaining element 11 in the retaining position.

The latch 12 is unlocked by tilting it forward, while pressing on its first arm 121. From a certain angle of rotation, the hook 123 no longer cooperates with the lower surface 114 of the second arm 113, thereby releasing the retaining element 11. The latter returns to the release position due to the spring 17 acting on the first arm 110 of the retaining element. In this configuration, the pin 112 no longer cooperates with the bore 302, and a portion of the retaining element 11 projects from the body, as shown in FIG. 2.

To switch to this configuration, the user can interrupt the grip of the handle 1 with his/her hand 4, while keeping the wrist strap 3 attached to the handle 1. By raising the index finger (or thumb) of the hand 4 and then pressing on the first arm 121 of the latch with this finger, the lever 12 pivots gradually until the hook 123 releases the lower surface 114 of the second arm 113 of the retaining element. Due to the spring 17, the retaining element switches to the position for releasing the fastening element 302. Then, with a natural and ergonomic tractive, or pulling, force exerted by the user on the tongue 301, when wishing to reach the first arm 121, the tongue 301 is removed from the housing 132 as it is no longer retained by the pin 112. Separation of the wrist strap 3 and the handle 1 can easily be achieved with one hand, i.e., the hand gripping the handle 1, without involving the other hand of the user.

Ergonomically, it is more natural to close the fingers by rolling the phalanges inward of the hand. The user has more strength and experiences less fatigue. Also, the kinematics of the mechanisms prove ergonomic. The retaining element 11 is actuated by the user's fingers closing on the handle. The latch 12 is actuated by pressing its first arm 121 forward, which corresponds to the rolling movement of the finger.

In this example, the return mechanism 17 is interposed between the first arm 121 of the latch 12 and the first arm 110 of the retaining element 11. This makes it possible to optimize the construction by using a single return mechanism. This return mechanism biases the latch 12 towards its position for locking the retaining element into the retaining position, on the one hand, and the retaining element 11 towards its position for releasing the fastening element of the wrist strap, on the other hand. This bias is continuous and constant, thereby enabling an automatic return to the previous stable positions. In addition, the return mechanism 17 is in direct contact with the latch 12 and in direct contact with the retaining element 11. This enables a better operation, without a risk of jamming.

To secure the mechanism in order to prevent accidental detachment of the wrist strap from the handle, a plurality of solutions are possible.

First, locking is advantageously provided by biasing the latch 12 towards its locking position, thus securing the mechanism.

Furthermore, with this construction, the user exerts a force on the lever 11 with the hand 4 when he/she has a normal grip position on the handle 1. This lever 11 then continuously keeps the pin 112 projecting through the housing 132. When the hand 4 of the user grips the handle 1, accidental detachment of the wrist strap 3 is avoided as the retaining element 11 is kept in the retaining position, even if pressure is accidentally applied on the latch 12.

Advantageously, the latch is positioned on the upper portion of the handle. Accordingly, in normal use, this zone is hardly in contact with the hand, thereby minimizing the risk of the user actuating the latch unintentionally. A deliberate action by the user is required for his/her hand to press on the latch 12 and detach the wrist strap 3.

Figure 4:
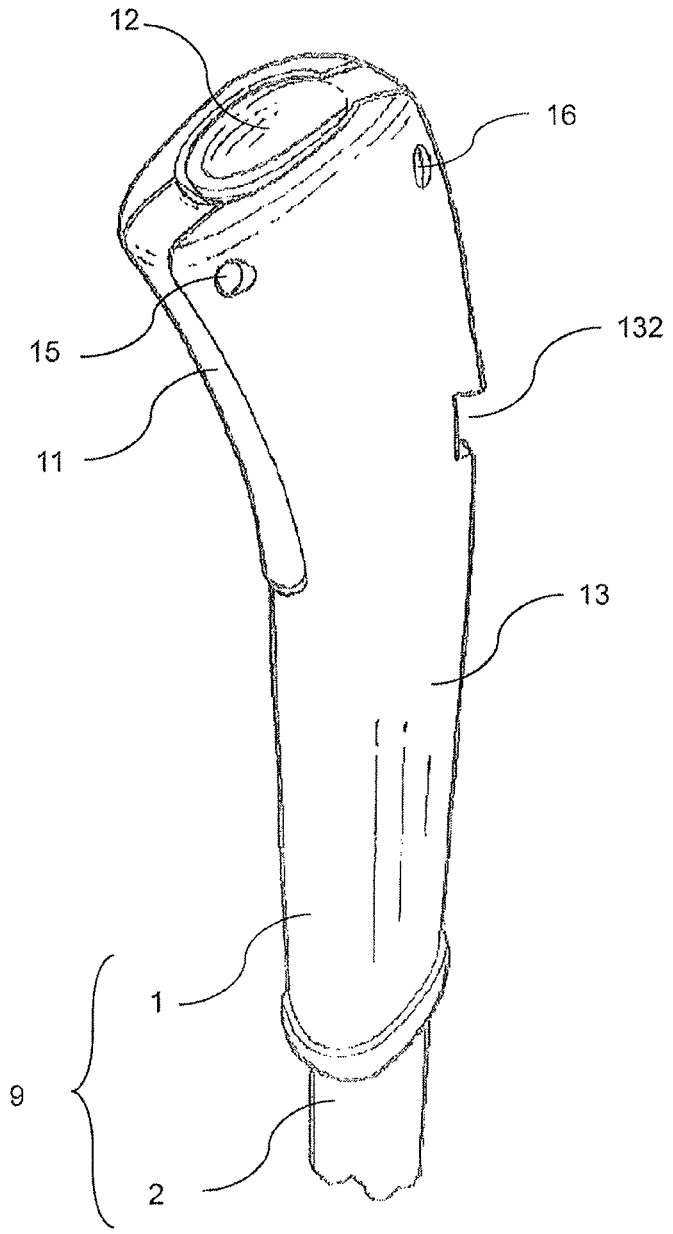
FIG. 4 is a perspective view of a pole handle according to a second embodiment.

FIG. 4 illustrates a second embodiment producing exactly the same principle of operation, with the difference that the latch 12 is recessed in relation to the upper surface of the body of the handle. Therefore, the same reference numerals are used for the elements. This alternative solution further secures the mechanism by preventing inadvertent contact on the top of the handle (obstacle, branch, etc.). Indeed, when one presses on the top of the handle over a large area, pressure is applied directly on the body and not on the latch. The latter is not actuated.

According to an alternative embodiment, the body may include a local lateral recess on the body, on both sides of the lever of the latch, to provide the possibility of actuating the latch from the side, using a finger. Because the recess is localized, safety of the mechanism is preserved against incidental contact.

In the first embodiment, the construction is reversed; the latch comprises a projecting portion to facilitate the actuation, at the risk of causing unintentional release.

To promote ergonomic use of the handle 1 in the configuration for retaining the wrist strap 3, the retaining element 11 is configured here so that its outer surface, i.e., the support surface 111, is flush with the envelope of the body 13. Thus, the retaining element 11 is well-integrated with the body and facilitates gripping for the user by reducing the asperities.

A handle 1 according to the invention makes it possible to selectively ensure its attachment to/detachment from the wrist the strap 3, with a particularly small number of components. Thus, such a handle 1 is reliable and relatively easy to manufacture.

A handle 1 of this type is also compatible with a wrist strap 3, the connecting element of which is a flexible tongue 301 that is easy to manufacture and does not cause discomfort when gripping other objects, such as a rifle during the practice of biathlon.

In the first illustrated embodiment, the first arm 121 of the latch 12 comprises lateral, downward returns overlapping the body 13 of the handle. This prevents undesired elements such as water or dust from penetrating into the recess 134, or possible pinching between the retaining element 11 and the latch 12.

The handle 1 shown is symmetrical in relation to a vertical plane including the longitudinal direction, which allows using a versatile handle 1, identical for left-handed and right-handed poles 9.

In these embodiments, the mechanism for retaining the wrist strap may have different kinematics, such as a horizontal translation of the pin cooperating with the fastening element of the strap, for example.

Also contemplated according to the invention is a housing designed to receive the fastening element oriented differently, enabling vertical insertion of the fastening element, for example.

The invention also applies to other types of fastening mechanisms between the wrist strap and the handle. The fastening element 302 of the wrist strap can be a plastic insert, a cord, a ring, etc. The complementary fastening mechanism may also be different, especially if using another fastening element.

Within the scope of the invention is the use of a retaining element having a different color and/or texture from the body in order to improve ergonomics. It can thus be provided that the element is more easily movable and actuated by the user.

Advantageously, the projecting portion of the retaining element, when in the release position, is slightly concave in its lower portion. This lower surface makes it possible to hang the pole on a rope, a rod, an edge, or a rim, for example.

The invention is not limited to the foregoing particularly disclosed embodiments. It is also possible to combine these embodiments.

The invention also extends to all of the embodiments covered by the annexed claims.

Further, at least because the invention is disclosed herein in a manner that enables one to make and use it, by virtue of the disclosure of particular exemplary embodiments of the invention, the invention can be practiced in the absence of any additional element or additional structure that is not specifically disclosed herein.

The invention claimed is:

1. An assembly of a pole and a wearable article, the assembly comprising:

a pole provided with a handle, and a wearable article designed to at least partially cover a hand of a user, the wearable article comprising a selectively removable fastening element designed to be selectively fastened to the handle;

the handle comprising:

a body comprising a housing designed to receive a portion of the fastening element;

a retaining element designed to cooperate with the fastening element when the portion of the fastening element is housed in the housing;

the retaining element movable in relation to the body, between a fastening-element-retaining configuration and a fastening-element-releasing configuration to allow the fastening element to be released from the housing of the body;

a latch separately movable in relation to the retaining element;

the latch being movable in relation to the body, between the following:

a locking position maintaining the retaining element in the fastening-element-retaining configuration; and an unlocking position not maintaining the retaining element in the fastening-element-retaining configuration;

a return mechanism biasing the latch towards the locking position.

2. An assembly according to claim 1, wherein:

the latch is a lever pivotally mounted in relation to the body about a tilting axis transverse to the body, the lever comprising a first arm extending forward of the handle, along a substantially horizontal direction, the forward tilting of the first arm causing unlocking of the retaining element.

3. An assembly according to claim 1, wherein:

the return mechanism is mounted to bias the retaining element towards the fastening-element-release configuration.

4. An assembly according to claim 3, wherein:

the return mechanism is interposed between the latch and the retaining element and thereby biases both the latch and the retaining element.

5. An assembly according to claim 1, wherein;

the retaining element is a lever pivotally mounted in relation to the body about a tilting axis transverse to the body, the lever comprising a first arm extending along a substantially vertical direction.

6. An assembly according to claim 5, wherein:

the lever has an outer surface provided on the first arm, flush with the body in the retaining position.

7. An assembly according to claim 1, wherein:

the retaining element comprises a support surface designed to be engaged by at least one finger of the user's hand to facilitate a manipulation by the user on the support surface to tilt the retaining element into the fastening-element retaining configuration.

8. An assembly according to claim 7, wherein:

the support surface of the retaining element has a length greater than one-third of a length of the body of the handle.

9. An assembly according to claim 1, wherein:

the handle is symmetrical in relation to a forwardly extending vertical plane.

10. An assembly according to claim 1, wherein:

the housing of the body opens out onto a rear portion of the handle.

11. An assembly according to claim 10, wherein:

the housing of the body is inclined in relation to a plane normal to the longitudinal direction of the body by an angle less than 60°.

12. An assembly according to claim 1, wherein:

the body comprises a local lateral recess on each of opposite sides of the latch.

13. An assembly according to claim 1, wherein:

the retaining element is pivotally mounted in relation to the body about a first axis, transverse in relation to the body of the handle; and the latch is pivotally mounted in relation to the body about a second axis, transverse in relation to the body of the handle, the first and second axes not being coaxial.

14. An assembly according to claim 13, wherein:

the first and second axes are parallel.

15. An assembly according to claim 1, wherein:

in each of the fastening-element-retaining configuration and the fastening-element-releasing configuration of the retaining element, the latch engages a respectively different portion of the retaining element.

16. An assembly according to claim 15, wherein:

each of the fastening-element-retaining configuration and the fastening-element-releasing configuration is a stable configuration of the retaining element.

17. A pole assembly for use with a wearable article having a fastening element, the pole assembly comprising:

a pole provided with a handle, and a handle secured to the pole, the handle comprising:

a body comprising a housing designed to receive a portion of the fastening element of the wearable article;

a retaining element designed to cooperate with the fastening element when the portion of the fastening element is housed in the housing;

the retaining element movable in relation to the body, between a fastening-element-retaining configuration and a fastening-element-releasing configuration to allow the fastening element to be released from the housing of the body;

a latch separately movable in relation to the retaining element;

the latch being movable in relation to the body, between the following:

a locking position maintaining the retaining element in the fastening-element-retaining configuration; and an unlocking position not maintaining the retaining element in the fastening-element-retaining configuration;

a return mechanism biasing the latch towards the locking position.

18. A handle designed to be secured to a pole of a pole assembly for use with a wearable article having a fastening element, the handle comprising:

a body comprising a housing designed to receive a portion of the fastening element of the wearable article;

a retaining element designed to cooperate with the fastening element when the portion of the fastening element is housed in the housing;

the retaining element movable in relation to the body, between a fastening-element-retaining configuration and a fastening-element-releasing configuration to allow the fastening element to be released from the housing of the body;

a latch separately movable in relation to the retaining element;

the latch being movable in relation to the body, between the following:

a locking position maintaining the retaining element in the fastening-element-retaining configuration; and an unlocking position not maintaining the retaining element in the fastening-element-retaining configuration;

a return mechanism biasing the latch towards the locking position.

19. A handle according to claim 18, wherein:

the retaining element is pivotally mounted in relation to the body about a first axis, transverse in relation to the body of the handle; and the latch is pivotally mounted in relation to the body about a second axis, transverse in relation to the body of the handle, the first and second axes not being coaxial.

20. A handle according to claim 18, wherein:

in each of the fastening-element-retaining configuration and the fastening-element-releasing configuration of the retaining element, the latch engages a respectively different portion of the retaining element.

* * * * *